United States Patent [19]

Conrad

[11] 4,031,853

[45] June 28, 1977

[54] DEVICE FOR APPLYING INK TO A RIBBON

[76] Inventor: Raymond L. Conrad, 1598 W. Burrel Ave., Visalia, Calif. 93277

[22] Filed: Feb. 17, 1976

[21] Appl. No.: 658,585

[52] U.S. Cl. ..... 118/264; 15/104.93; 15/210 B

[51] Int. Cl.[2] ..... B05C 11/00

[58] Field of Search ..... 118/264, 260, 266, 256, 118/258, 259, DIG. 14, DIG. 15; 427/146; 15/21 D, 159 R, 210 B, 210 A, 218.1, 230.11, 236 A, 244 A, 104.92, 104.93; 401/196

[56] References Cited

UNITED STATES PATENTS

| | | | |
|---|---|---|---|
| 1,192,686 | 7/1916 | Rieger | 15/210 B |
| 2,148,009 | 2/1939 | Bing | 15/210 B |
| 2,705,499 | 4/1955 | Breeze | 15/230.11 X |
| 2,743,470 | 5/1956 | Horowitz | 118/264 X |
| 2,788,537 | 4/1957 | Greenberg | 15/244 A |
| 2,819,484 | 1/1958 | Fouse | 15/244 A |
| 3,333,569 | 8/1967 | Swenson | 118/260 |
| 3,450,140 | 6/1969 | Vail | 15/210 A |
| 3,791,330 | 2/1974 | Haddad | 15/210 B |

*Primary Examiner*—Louis K. Rimrodt
*Attorney, Agent, or Firm*—Huebner & Worrel

[57] ABSTRACT

A method and device for applying ink to a ribbon, such as a typewriter ribbon or the like. The device is characterized by a pair of ink-absorbent pads resiliently supported in a mutually opposed relationship for transferring ink to a ribbon as the ribbon is drawn between the pads in face-to-face engagement therewith.

1 Claim, 3 Drawing Figures

DEVICE FOR APPLYING INK TO A RIBBON

BACKGROUND OF THE INVENTION

The invention generally relates to a method and device for applying ink to ribbons, such as typewriter ribbons and the like, and more particularly to a method, and a device for performing the method, having particular utility in revitalizing ribbons from which ink has been depleted.

As can be appreciated by those familiar with the use of ribbons provided for typewriters and the like, ink applied to such ribbons has a propensity to evaporate, as well as to experience depletion as a consequence of normal usage. A loss of ink from such ribbons results in reduced lubriciousness and resiliency. Consequently, ribbons from which ink has been lost tend to experience excessive wear when subjected to normal usage.

Of course, where a typewriter is employed infrequently, it often is deemed impractical and/or uneconomical to replace the typewriter as new models appear on the market. Hence, it sometimes becomes difficult to locate replacement ribbons for mechanically sound but obsolete typewriters, simply because of problems directly attributable to obsolescence. It can, therefore, be appreciated that loss of ribbon ink, due to evaporation, may lead to excessive ribbon wear, which, in turn, can result in a loss of an otherwise serviceable typewriter.

Unfortunately, no practical methods suitable for re-inking ribbons, or devices capable of performing such methods, are known to exist. It should be apparent that there currently exists a need for a method and device through a use of which ribbons for typewriters and the like are revitalized as ink is applied thereto.

It is, therefore, a general purpose of the instant invention to provide a method, and a device for performing the method, through which ribbons such as ribbons for typewriters and the like are revitalized as ink lost through evaporation and/or normal usage is replenished.

OBJECTS AND SUMMARY OF THE INVENTION

It is, therefore, an object of the instant invention to provide a method and a device for revitalizing typewriter ribbons and the like.

Another object is to provide a method for applying ink to ribbons whereby re-inking is facilitated.

It is another object to provide a device for applying ink to typewriter ribbons, preparatory to subsequent usage.

Another object is to provide a method and a device for applying ink to ribbons, such as ribbons for typewriters and the like, whereby the ribbons are revitalized preparatory to usage.

Another object is to provide a method and a device particularly suited for use in re-inking typewriter ribbons, although not necessarily restricted in use thereto, since the method and device may be similarly useful when employed in inking ribbons for other devices which utilize inked ribbons for printing operations.

These and other objects and advantages are achieved through the use of a method, and device for performing the method, which includes applying opposed ink-bearing pads to a ribbon as the ribbon is drawn therebetween in engagement therewith, for purposes of discharging ink from the pads onto the surface of the ribbon, as will become more readily apparent by reference to the following description and claims in light of the accompanying drawings.

DESCRIPTION OF THE PREFERRED EMBODIMENTS

Figure 1:
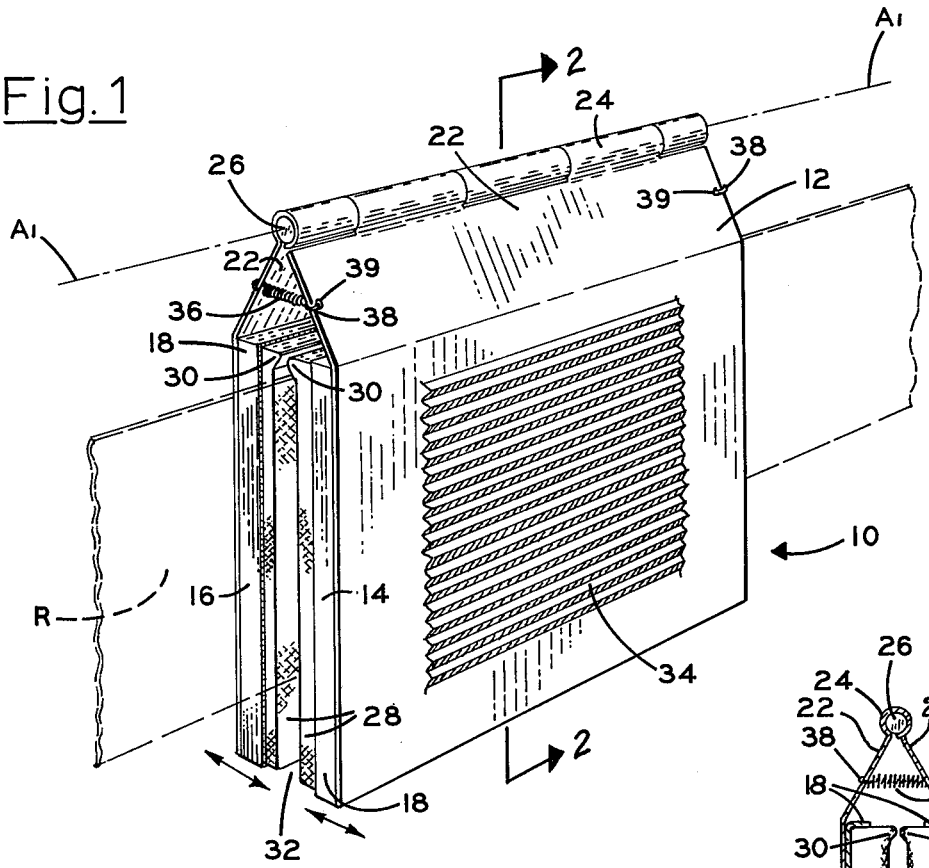
FIG. 1 is a perspective view of a device comprising one embodiment of the instant invention.
Figure 2:
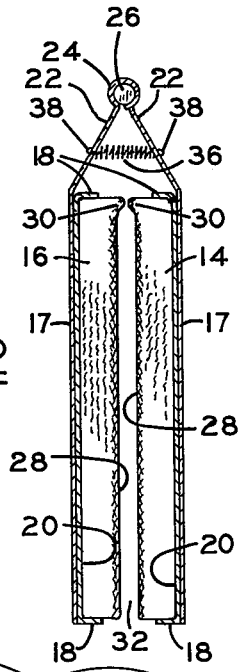
FIG. 2 is a cross-sectional view taken generally along line 2—2 of FIG. 1.

Referring now to the drawings wherein like reference characters designate like or corresponding parts throughout the several views, there is shown in FIG. 1 a device 10 embodying the principles of the instant invention particularly suited for use in performing a method which also embodies the principles of the invention.

The device 10 includes a case 12 formed of a suitable material, such as PVC (polyvynlchloride) or the like. The case 12 is fabricated employing any suitable means such as devices capable of stamping and/or extruding components of the case.

The case 12 includes a pair of opposed case halves, designated 14 and 16, of similar construction. Each of the case halves includes a backing plate 17 having an endless lip 18 extended substantially along the periphery thereof. The lip projects from the plane of the backing plate and defines a pad-supporting cavity 20, the purposes of which will hereinafter become more readily apparent.

Furthermore, from each of the backing plates 17 there is extended a hinge plate 22. The hinge plate is integrally related with the back plate 17 and is angularly related to the plane thereof. A plurality of mutually spaced, coaxially aligned barrels 24 project from each of the hinge plates and receive in interspersed coaxially aligned relation the barrels 24 projected from the other hinge plate 22. The barrels 24 receive a hinge pin 26 whereby the hinge plates 22 of the case halves 14 and 16 are connected for pivotal displacement about a common axis of rotation, designated A1.

Within each of the pad-supporting cavities 20 there is seated an ink-absorbent pad 28. The pads 28 are formed of any suitable material such as cotton, felt, and the like, and project outwardly into an opposed relationship. However, where so desired, spacing between the pads is provided for receiving a ribbon, designated R. Such spacing is achieved simply by increasing the thickness dimension of each of the pads along one edge thereof to form an elongated protuberance 30 in juxtaposition with the axis A1. Thus, as the protuberances 30 are brought into engagement a throat 32 is established for receiving the ribbon R, as schematically illustrated in FIG. 1.

It is, in practice, desirable for the case halves 14 and 16 to be urged toward a common plane for simultaneously engaging the opposite faces of the ribbon R. Toward this end there is provided a pair of tension springs 36 which are connected between the hinge plates 22 for the case halves 14 and 16. Preferably, the springs 36 are connected with the hinge plates through the use of hooks 38 received in apertures 39. Consequently, the case halves are continuously urged in pivotal displacement about the axis A1, toward the ribbon R. However, the elongated protuberance 30 assures that a binding relationship is not established between the adjacent surfaces of the pad and the ribbon.

Additionally, where so desired, anti-skid surfaces 34 are provided along the outermost surface of the case halves 14 or 16 for aiding operators in grasping and applying pressure to the case halves when the device operatively is employed.

ALTERNATE EMBODIMENT

Figure 3:
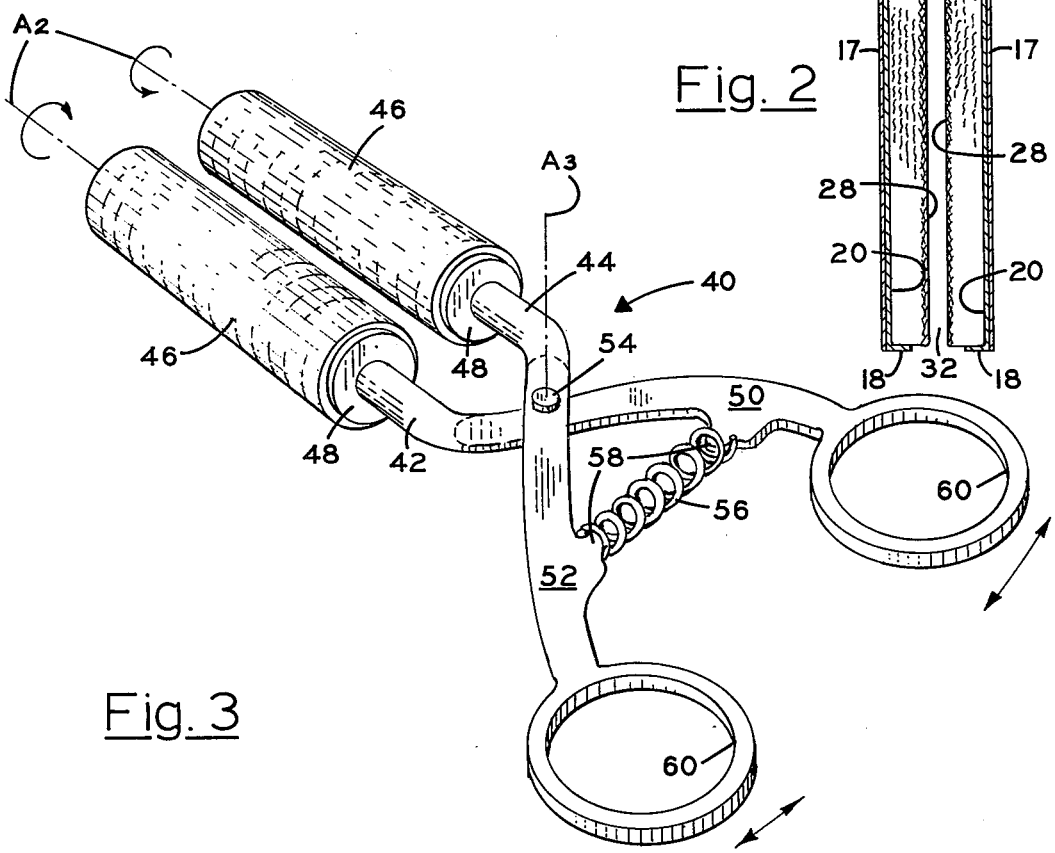
FIG. 3 is a perspective view of a device comprising an alternate embodiment of the invention.

Attention is now invited to FIG. 3 of the drawings wherein is illustrated a device, designated 40, which comprises a further embodiment of the instant invention. The device 40 functions to achieve a result quite similar to the results achieved through the use of the device 10 hereinbefore described.

The device 40, as shown, includes a pair of bearing shafts 42 and 44. These shafts serve to support ink-absorbent pads 46, each being of a cylindrical configuration. As a practical matter, the pads 46 are supported for rotation about the longitudinal axis of the bearing shafts 42 and 44 by suitable bearings 48. Where so desired, the bearings 48 are formed as simple spools concentrically received within the pads 46 and are provided with tubular openings through which the shafts 42 and 44 extend. In any event, it is to be understood that the pads 46 are supported for free-running rotation about axes, designated A2, by the bearing shafts 42 and 44.

The shafts 42 and 44 also include abaxially projected handles 50 and 52. These handles are pinned together by a pivot pin 54, to form a scissor linkage, and support the shafts 42 and 44 for pivotal displacement about an axis designated A3, FIG. 3. As can be fully understood by those familiar with scissor linkages, the handles 50 and 52, when simultaneously displaced in a closing relationship, serve to separate the pads 46 simultaneously. Conversely, simply by separating the handles 50 and 52, the pads 46 are caused to approach a common plane extended therebetween. In practice, the handles 50 and 52 are provided with an interconnecting compression spring 56 seated on opposed tangs 58 which serve to continuously urge the handles 50 and 52 in separating displacement, whereby the pads normally are maintained in juxtaposition. By manipulating the handles 50 and 52 for compressing the spring 56, however, the shafts 42 and 44 are simultaneously displaced in separation. Where so desired, rings 60 are provided at the distal ends of the handles 50 and 52 for receiving the fingers of an operator as an aid during manipulation of the handles. Hence, it should be apparent that the pads 46 are readily separated for receiving a ribbon, such as the ribbon R, simply by manipulating the handles 50 and 52, while the spring 56 serves to urge the pads into face-to-face engagement with the ribbon.

OPERATION

It is believed that in view of the foregoing description, the operation of the device will readily be understood and it will be briefly reviewed at this point.

In employing either of the devices designated 10 or 40, it is possible to apply ink to a ribbon, such as that designated R in FIG. 1.

Referring first to the operation of the device designated 10, an operator initially deposits a determinable quantity of ink of a suitable formulation on both of the pads 28. A ribbon R is then interposed between the pads, simply by inserting the ribbon into the throat 32. Due to the force applied to the case halves 14 and 16, by the springs 36, the pads 28 are continuously urged to assume an engaged relationship with the ribbon. The ribbon is then drawn through the pads with the ink being dispensed from the absorbent material of the pads and transferred to the surfaces of the ribbon. The protuberances 30, of course, maintain suitable separation between the pads for thus precluding an establishment of excessive resistance through the frictional contact of the pads with the ribbon.

Turning now to FIG. 3, it should be apparent that the device 40 is operated in a manner quite similar to that in which the device 10 is operated.

Initially, the pads 46 are inked through an application of a suitable quantity of a selected ink. The handles 50 and 52 are manipulated and thus are displaced in a closing direction, against the spring 56, for thus separating the pads 46. A selected ribbon is now inserted between the pads 46, and the handles permitted to open in response to the applied forces of the spring 56. The spring 56 serves to continuously urge the pads into engagement with the opposite faces of a ribbon. By drawing the ribbon thus received between the pads 46, rotation about axes A2 is imparted to the pads 46, and ink is dispensed from the pads to the surface of the ribbon. The effects of friction resulting from sliding engagement of the ribbon with the pads is avoided as rotation of the pads is accommodated by the shafts 42 and 44. Of course, a subsequent manipulation of the handles 50 and 52, by inserting the fingers into the digital rings 60 and compressing the spring 56, serves to release the ribbon in its inked condition.

While the structure employed in drawing the ribbon R between the pads 28, or 46, forms no specific part of the instant invention, it is to be understood that a hand-held, reversible motor, not shown, having a rotatable shaft connected with one of a pair of reels for the ribbon R can be employed quite satisfactorily for drawing it between the pads. A connection of the motor with the reel is achievable through a use of a suction cup, also not shown.

In view of the foregoing, it should readily be apparent that either of the devices 10 or 40 is particularly suited for use in applying ink to a ribbon for purposes of achieving a revitalization of the ribbon, whereby savings in both the costs of ribbons and in typewriting machines are realized.

Although the invention has been shown and described in what are conceived to be the most practical and preferred methods and devices, it is recognized that departures may be made therefrom within the scope of the invention, which are not to be limited to the illustrative details disclosed.

Having described my invention, what I claim as new and desire to secure by Letters Patent is:

1. A device for applying liquid ink to a ribbon for a typewriter comprising:

A. a case of a substantially planar configuration including a pair of opposed case halves, each case half being characterized by an endless lip projected from the periphery thereof for defining in said case a pair of pad cavities;

B. a pair of ink absorbent pads each being seated in a pad cavity and characterized by a face of a substantially planar configuration;

C. hinge means interconnecting said case halves for pivotal displacement about a common axis including a linear hinge member extended in spaced relation with adjacent edge portions of said case halves;

D. means for continuously urging the case halves in pivotal displacement for positioning the face of each pad of said pair of pads in an opposed relationship with the face of the other pad of the pair; and E. stop means for limiting the pivotal displacement of said case halves about said axis including stop means comprising a linear protuberance projected from one edge surface of the face of each pad of said pair of pads and extended in spaced parallelism with said axis for engaging the protuberance projected from the face of the other pad of the pair as the case halves are pivotally displaced.

* * * * *